US008500127B2

(12) United States Patent
Gette

(10) Patent No.: US 8,500,127 B2
(45) Date of Patent: Aug. 6, 2013

(54) BI-DIRECTIONAL METAL-TO-METAL SEAL

(75) Inventor: Nicholas Peter Gette, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 389 days.

(21) Appl. No.: 12/844,702

(22) Filed: Jul. 27, 2010

(65) Prior Publication Data

US 2012/0025470 A1 Feb. 2, 2012

(51) Int. Cl.
*E21B 33/04* (2006.01)

(52) U.S. Cl.
USPC ..... 277/338

(58) Field of Classification Search
USPC ..... 277/337–341
See application file for complete search history.

(56) References Cited

U.S. PATENT DOCUMENTS

| | | | | |
|---|---|---|---|---|
| 4,932,472 | A | 6/1990 | Boehm, Jr. | |
| 4,949,787 | A | 8/1990 | Brammer et al. | |
| 5,456,314 | A * | 10/1995 | Boehm et al. | 166/208 |
| 6,510,895 | B1 * | 1/2003 | Koleilat et al. | 166/208 |
| 6,969,070 | B2 * | 11/2005 | Reimert et al. | 277/323 |
| 7,762,319 | B2 | 7/2010 | Nelson | |
| 8,186,426 | B2 * | 5/2012 | Nelson | 166/88.3 |
| 8,245,776 | B2 * | 8/2012 | Gette et al. | 166/195 |
| 2008/0135229 | A1 | 6/2008 | Hunter et al. | |

FOREIGN PATENT DOCUMENTS

| | | |
|---|---|---|
| EP | 233234 A2 | 6/2011 |
| GB | 2270939 A | 3/1994 |
| GB | 2314867 A | 1/1998 |

OTHER PUBLICATIONS

Search Report from corresponding GB Application No. GB1112192.8 dated Oct. 14, 2011.

* cited by examiner

*Primary Examiner* — Gilbert Lee
(74) *Attorney, Agent, or Firm* — Bracewell & Giuliani LLP

(57) ABSTRACT

A wellhead seal assembly that forms a metal-to-metal seal between inner and outer wellhead members. A metal seal ring has inner and outer legs that are threaded to each other and separated by a slot and provide bi-directional sealing. The threaded connection provides a pathway for annular pressure into the slot. The inner and outer legs have inner and outer walls, respectively. Inner and outer legs have a soft metal inlay on their interior surfaces. Wickers may be located on the outer surface of the inner wellhead member and on the inner surface of the outer wellhead member. An energizing ring is moved into the slot to force the outer and inner walls of the seal into sealing engagement with the inner and outer wellhead members. The soft metal inlays deform onto the energizing ring. If present, wickers on the wellhead members embed into the walls of the seal ring.

20 Claims, 3 Drawing Sheets

BI-DIRECTIONAL METAL-TO-METAL SEAL

FIELD OF THE INVENTION

This invention relates in general to wellhead assemblies and in particular to a seal for bi-directionally sealing between inner and outer wellhead members.

BACKGROUND OF THE INVENTION

Seals or packoffs are typically used as a pressure barrier in the annular space between inner and outer wellhead tubular members for containing internal well pressure. The inner wellhead member may be a casing hanger located in a wellhead housing and that supports a string of casing extending into the well or a tubing hanger that supports a string of tubing extending into the well for the flow of production fluid. Casing hangers generally are landed in a wellhead housing whereas tubing hangers are typically landed in one of a wellhead housing, a Christmas tree, or a casing hanger.

A variety of seals of this nature have been employed in the prior art. Prior art seals include elastomeric and partially metal and elastomeric rings. Prior art seal rings made entirely of metal for forming metal-to-metal seals are also employed. The seals may be set by a running tool, or they may be set in response to the weight of the string of casing or tubing. One type of prior art metal-to-metal seal is U-shaped, having inner and outer walls separated by a cylindrical slot. A wedge-shaped energizing ring is pushed into the slot in the seal to deform the inner and outer walls apart into sealing engagement with the inner and outer wellhead members. The deformation of the seal's inner and outer walls exceeds the yield strength of the material of the seal ring, making the deformation permanent.

The U-shaped geometry of the seal allows bore pressure to act on the legs and thereby improve sealing with increased pressure. However, pressure in the annulus below the casing hanger has the opposite effect on the seal and will result in a leak if the pressure is great enough. Further, the bore pressure tends to degrade the performance of the annulus seal over time. This is because the contact pressure at the sealing surfaces of the seal is not only enhanced by the U-shaped geometry but also the hanger neck geometry, which further compresses the sealing surfaces when the hanger is exposed to pressure along its bore. These two pressure enhancing factors typically exceed the preload of the annulus seal, resulting in plastic deformation that may decrease contact force in the sealing surfaces over time and in turn cause leaks.

One approach taken to address this leakage problem in metal-to-metal seals has been the addition of a set of wickers to the exterior of the casing hanger and the bore of the wellhead housing. The wickers on both the casing hanger and wellhead housing sealingly engage the sealing surfaces of the U-seal after they are deformed by the energizing ring. The wickers aim to prevent axial movement of the seal and focus the radial sealing force over a narrow band. However, with increases in production pressure, pressure cycles, and plastic deformation of the seal's contact surfaces, leaks may still develop in the seal.

A need exists for a technique that addresses the seal leakage problems described above. In particular a need exists for a technique to maintain a seal between inner and outer wellhead members experiencing changes in relative positions due to thermal affects, especially those caused by high pressure and pressure cycle wellbore conditions. The following technique may solve these problems.

SUMMARY OF THE INVENTION

In an embodiment of the present technique, a seal assembly is provided that forms a metal-to-metal seal and has features that restrain axial movement of the seal assembly. The seal assembly also has features that maintain the seal even when increased pressure effects act on the seal. The seal ring has inner and outer walls separated by a slot. In the illustrated embodiments, the inner and outer walls of the seal ring comprise two separate pieces that are threaded together, with the outer piece or outer leg resting on an upward facing shoulder formed on the other piece or inner leg. A metal energizing ring is pushed into the slot during installation to deform the inner and outer walls into sealing engagement with inner and outer wellhead members.

In the illustrated embodiments, a radial gap exists between the outer wall of the seal and the inner wall of the mating housing. Such gap is required for installation in the field and is sufficiently large to require plastic deformation of the seal body, but not the energizing ring. The threaded connection between the inner and outer legs of the seal forms a pathway for fluid pressure in the annulus below the seal to enter the slot. Thus, an increase in annulus pressure below the seal will produce an increase in pressure in the slot between the inner leg and outer leg. This increase in pressure urges the inner leg inward and the outer leg outward, creating better seals. Because annulus pressure may act on the bottom of the energizing ring through the thread between the inner and outer wellhead housing, a soft metallic inlay is formed on the interior surfaces of the seal legs to effect a gas-tight seal and accommodate sealing over scratches and surface trauma of the energizing ring. Alternatively, raised surfaces on the energizing ring may also function to provide a seal.

The inlays may have grooves formed on the sealing side of the inlay and are preferably in a V configuration to assist in the flow of inlay material to provide a seal. The size and thickness of the metallic inlays are sufficient to provide for scratch filling and therefore sealing between the energizing ring an the interior surfaces of the seal legs. Further, wickers may be used on the exterior of the casing hanger and the bore of the wellhead housing that sealingly engage the U-seal's inner and outer walls In this invention, a gas-tight seal is effected between the energizing ring and the interior surfaces of the seal legs to prevent bore pressure from entering the U portion of the seal, thereby reducing the excessive pressure enhancement due to bore pressure. Even after exposure to numerous pressure cycles, this new feature will allow the seal to retain a greater percentage of its initial elastic energy, which will allow for better performance over time.

In the embodiment shown, the two separate leg features also allow the annulus seal to accommodate a greater range of axial movement. This reduces the stress at the base of the U-seal, reducing the possibility of the seal cracking in half due to stress buildup related to axial movement against a wicker profile of the wellhead members, if wickers are used. Further, the new design eliminates the need for longer hanger necks or special running tools, the elimination of load rings on second and possibly third position hangers due to the enhanced axial movement allowance of the new seal. Also, the quality and cost of manufacture for the seal leg arrangement is improved.

The combination of stored energy provided for by the energizing rings, the sealing mechanisms of the U-seal leg interior surfaces and the energizing ring, the wicker profiles on the seal-facing surfaces of the wellhead bore and casing hanger, and the threaded two-piece U-seal leg construction, provides enhanced cyclical performance, improved lock-down capability with annulus pressure, improved cost to manufacture, and a decrease in potential leaks. Alternatively, the soft inlays may be made from a non-metallic material or polymer such as PEEK (poly-ether-ether-keytone) or PPS (polyphenylene sulfide).

DETAILED DESCRIPTION OF THE INVENTION

Figure 1:
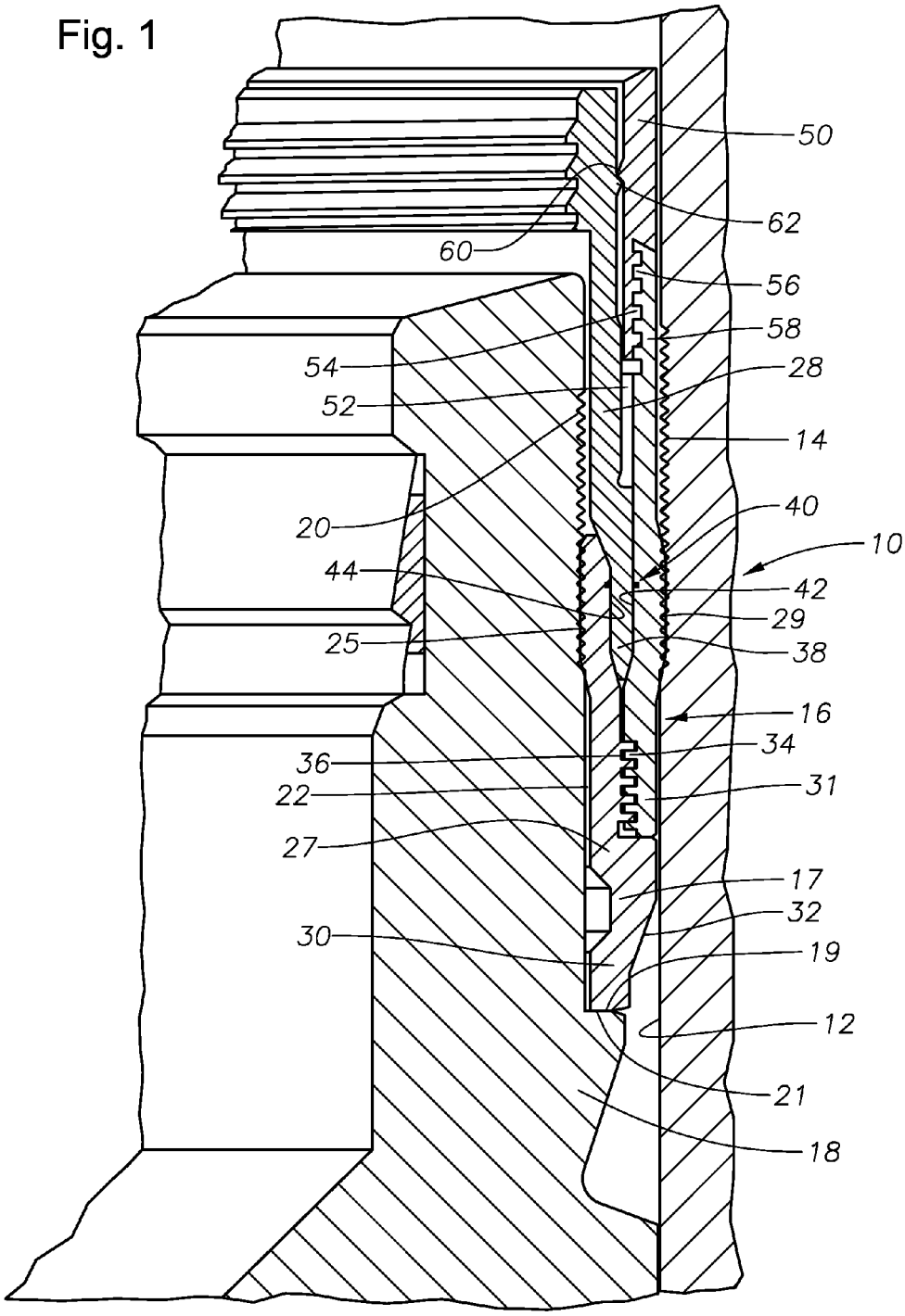
FIG. 1 is a sectional view of a seal assembly with the energizing ring in an energized position, in accordance with an embodiment of the invention.

Referring to FIG. 1, an embodiment of the invention as installed is illustrated and shows a portion of a high pressure wellhead housing 10. Housing 10 is located at an upper end of a well and serves as an outer wellhead member in this example. Housing 10 has a bore 12 located therein.

In this example, the inner wellhead member comprises a casing hanger 18, which is shown partially in FIG. 1 within bore 12. Alternately, wellhead housing 10 could be a tubing spool or a Christmas tree; and casing hanger 18 could instead be a tubing hanger, plug, safety valve, or other device. Casing hanger 18 has an exterior annular recess radially spaced inward from bore 12 to define a seal pocket 22. In this embodiment, wickers 14 are located on the wellhead bore 12 and wickers 20 are located on the cylindrical wall of seal pocket 22. However, in other embodiments, the wellhead 10 and the casing hanger 18 may have smooth sealing surfaces, rather than wickers 14, 20. In this example, the profiles of each set of wickers 14, 20 are located on only portions of the wellhead bore 12 and seal pocket 22. However, the wickers 14, 20 may be configured in other arrangements.

A metal-to-metal seal assembly 16 is located in seal pocket 22. Seal assembly 16 includes a seal ring 17 formed of a metal such as steel. Seal ring 17 has an inner wall 25 comprised of inner seal leg 27 for sealing against the cylindrical wall of casing hanger 18. Seal ring 17 has an outer wall surface 29 comprised of outer seal leg 31 that seals against wellhead housing bore 12. In this embodiment, each wall surface 25, 29 is curved and smooth. However, in other embodiments the wall surfaces 25, 29 may have a protrusion, or protrusions, so that contact forces are localized. A lower extension 30 of the seal ring 17 has a downward facing surface 21 shown landed on an upward facing shoulder 19 of the casing hanger 18. In this embodiment, a lower portion of leg 26 circumscribes an upper portion of leg 27, the lower end of the leg 26 lands on a shoulder on the leg 27, the outer surface of the leg 27 tapers radially inward below that shoulder and above the lower surface 21. Threads 34, 36 are just above the shoulder, and the leg 26 extends above the upper end of leg 27.

Figure 2:
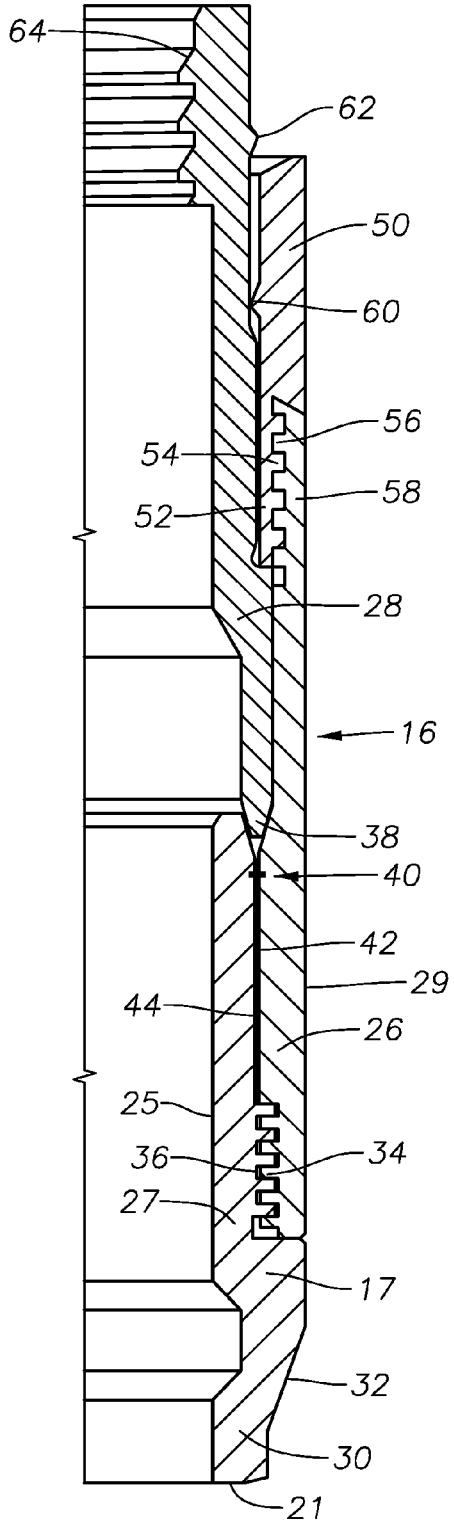
FIG. 2 is an enlarged sectional view of the seal assembly of FIG. 1 in an un-energized position, in accordance with an embodiment of the invention.

In this example, seal ring 17 is bi-directional due to the inner and outer seal legs 27, 31 being two separate pieces, as shown in FIGS. 1 and 2. The inner seal leg 27 has threads 36 that correspond to threads 34 formed on the outer seal leg 31. Thus, pressure from the annulus below can enter via space between threads 34, 36 and act on the nose 38 of the energizing ring 28 from below. The annulus pressure further acts against the inner surface 42 of the outer seal leg 31 and the inner surface 44 of the inner seal leg 27 to enhance the contact at the casing hanger 18 and the wellhead housing 10 sealing surfaces 22, 11. This greatly improves sealability and lock-down resistance to annulus pressure. To seal the inner surfaces 42, 44 around the portion of energizing ring 28 between the inner surfaces, soft metal inlays 40 may be contained on portions of the inner surfaces 42, 44 that deform against the energizing ring 28 when the seal assembly 16 is energized. Although shown as rectangles in FIGS. 1-3, the inlays 40 may have grooves (not shown) formed on the sealing side of the inlay 40. The grooves, that may be in a V configuration, assist in the flow of inlay material to provide a seal.

The inlays 40 of this example may be formed of a soft metal such as tin indium or alternatively made from a non-metallic material or polymer such as PEEK (poly-ether-ether-keytone) or PPS (polyphenylene sulfide).

Continuing to refer to FIG. 1, a retaining nut 50 having an inner diameter 52 holds the seal assembly 16 together during installation. The retaining nut 50 has threads 54 that correspond to threads 56 formed on an upper outer leg portion 58, allowing for threading engagement of the retaining nut 50 with the seal assembly 16. A protrusion 60 is formed on the inner diameter 52 of the retaining nut 50 that interferes with a protrusion 62 formed on the interior surface of the energizing ring 28 when set. The sides of the protrusions 60, 62 in contact with each other are flatter to prevent the energizing ring 28 from backing out. Conversely, the sides of the protrusions 60, 62 that must slide past each other as the energizing ring 28 is forced downward are tapered to allow ease of movement. In this embodiment, the respective upper and lower surfaces of the protrusions 62, 60 have a slope greater than the respective lower and upper surfaces of the protrusions 62, 60. Thus, as the seal assembly 16 is being energized and the energizing ring 28 is urged downward, the smaller respective slopes of the lower and upper surfaces of the protrusions 62, 60 can slide past one another allowing further insertion of the energizing ring 28. However, the respective larger slopes of the upper and lower surfaces of the protrusions 62, 60 provide an obstacle to upward movement of the energizing ring 28 with respect to the retaining nut 50 to prevent upward backoff of the energizing ring 28.

Figure 3:
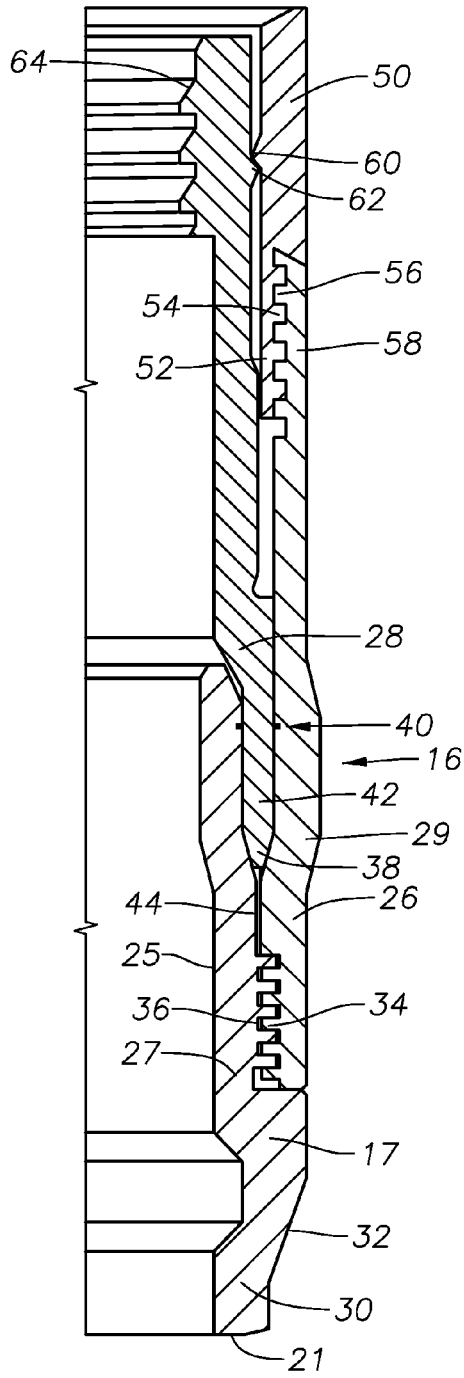
FIG. 3 is an enlarged sectional view of the seal assembly of FIG. 1 in the energized position with deformation of the seal and soft inlay material sealing against the energizing ring, in accordance with an embodiment of the invention.
Figure 4:
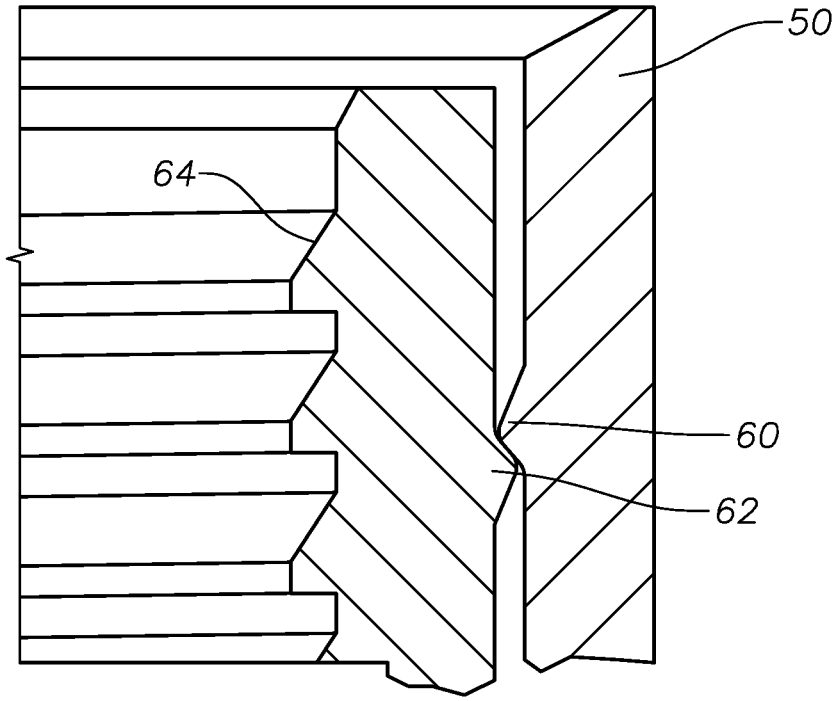
FIG. 4 is an enlarged sectional view of the interference between the energizing ring and a nut forming part of seal assembly, in accordance with an embodiment of the invention.

Referring to FIGS. 2-4, during installation, a running tool (not shown) may thread onto a set of threads 64 formed on an upper end of the energizing ring 28 to run the seal assembly 16 into the annular space between the casing hanger 18 and the wellhead housing 10. For clarity, the wellhead 10 and casing hanger 18 are not shown in FIGS. 2-4. As described in a previous paragraph, in an example embodiment, the components comprising the seal assembly 16 are pre-assembled with energizing ring 28, retaining nut 50, seal ring 17, and extension 30 all connected to one another.

In an example of assembly, the seal assembly 16 is lowered into the annular space between the casing hanger 18 and the wellhead housing 10 until the downward facing shoulder 21 on the lower extension 30 lands on the upward facing shoulder 19 of casing hanger 18. The outer wall 29 of outer seal leg 31 will be closely spaced to wickers 14 on the wellhead bore 12. The inner wall 25 of inner seal leg 27 will be closely spaced to the wickers 20 on the cylindrical wall of seal pocket 22. Once the assembly 16 is landed, the upward facing shoulder 19 on the casing hanger 18 provides a reaction point for the energizing ring 28 to be forced downward by the running tool with sufficient force such that the nose 38 engages a pocket defined by the inner surfaces 42, 44 of the outer and inner legs 27, 31 of the seal ring 17 to cause the inner and outer seal legs 27, 31 to move radially apart from each other as shown in FIG. 3. The inner wall 25 of inner seal leg 27 will embed into wickers 20 (FIG. 1) in sealing engagement while the outer wall 29 of outer seal leg 31 will embed into wickers 14 (FIG. 1) in sealing engagement. Further, the soft metal inlays 40 on the inner surfaces 42, 44 of the outer and inner seal legs 31, 27 will deform against the outer and inner surfaces of the nose 38 of the energizing ring 28 to provide a gas-tight seal. Alternatively, raised surfaces on the energizing ring 28 may provide a seal instead of the metal inlay 40.

During the downward movement of the energizing ring 28 relative to the seal assembly 16, the energizing ring 28 rides against the inner surface of the retaining nut 50. As shown in FIGS. 3 and 4, the protrusion 62 on the outer surface of the energizing ring 28 slides past the protrusion 60 formed on the inner surface of the retaining nut 50. The sides of the protrusions 60, 62 in contact with each other are flatter to prevent the energizing ring 28 from backing out of the seal ring 16, resulting in locking engagement of the retaining ring 28 with the retaining nut 50. Because the outer and inner seal legs 27, 31 of the seal ring 16 are threaded, annulus pressure below the seal ring 16 may act on the nose 38 at the bottom of the energizing ring 28 through the thread between the inner and outer seal legs 27, 31. The gas tight seal formed by the metal inlays 40 deformed against the nose 38 provides a seal against the annulus pressure from below. Alternatively, seal assembly 16 and energizing ring 28 may be part of a string that is lowered into bore 12, the weight of which forces the nose 38 of the energizing ring 28 into a slot defined by the inner surfaces 42, 44 of the outer and inner seal legs 31, 27. If retrieval is required, the threads 64 can be engaged by a retrieving tool (not shown) to pull energizing ring 28 from set position. Energizing ring 28 can be formed of metal, such as steel.

Subsequently, during production, annular well pressure will communicate through the threads 34, 36, at the bottom of the seal ring 16 and to between the outer and inner seal legs 31, 27. The pressure is thus exerted on the inner surfaces 42, 44 of the outer and inner seal legs 31, 27 resulting in increased contact pressure of the seal ring 16 with the outer and inner wellhead members 10, 18. The wickers 14,20 will maintain sealing engagement with the inner wall 25 of inner seal leg 27 and the outer wall 29 of outer seal leg 31. As noted above, the inlays 40 provide a pressure barrier between the outer and inner seal legs 31, 27 and the lower end of the energizing ring 28.

In the event that seal assembly 16 is to be removed from bore 12, a running tool is connected to threads 64 on upper energizing ring 28. An upward axial force is applied to upper energizing ring 28, causing it to withdraw from the seal ring 16.

In an additional embodiment (not shown), the wellhead housing 10 could be a tubing spool or a Christmas tree. Furthermore, the casing hanger 18 could instead be a tubing hanger, plug, safety valve or other device. The seal assembly 16 can also be used in a wellhead assembly not having wickers.

While the invention has been shown in only one of its forms, it should be apparent to those skilled in the art that it is not so limited but is susceptible to various changes without departing from the scope of the invention.

What is claimed is:

1. A wellhead assembly with an axis, comprising:

an outer wellhead member having a bore;

an inner wellhead member adapted to be located in the bore;

opposing seal surfaces in the bore and on an exterior portion of the inner wellhead member;

a seal ring between the inner and outer wellhead members having an inner annular member and an outer annular member circumscribing a portion of the inner annular member, the inner and outer annular members being secured to each other by threads, the threads terminating below upper ends of the inner and outer annular members, defining a slot between the inner and outer annular members above the threads;

an annular energizing ring having a lower end insertable into the slot, so that when the lower end of the energizing ring is inserted into the slot the inner and outer annular members of the seal ring above the threads are urged radially outward into sealing engagement with the seal surfaces of the inner and outer wellhead members, and the lower end of the energizing ring forms metal-to-metal sealing engagements with wall surfaces of the inner and outer annular members that define the slot; and wherein the threads define a pathway for fluid to flow from the bore below the seal ring into the slot and into contact with the lower end of the energizing ring, wherein fluid pressure in the bore below the seal ring produces a force within the slot to urge the inner annular member of the seal ring inward and the outer annular member of the seal ring outward.

2. The assembly according to claim 1, wherein;

an inlay band of a deformable material is formed on at least one of wall surfaces of the inner and outer annular members that define the slot; and wherein the energizing ring deforms the inlay band when fully located within the slot.

3. The assembly according to claim 2, wherein the inlay comprises a material that is selected from the list consisting of a metal, a non-metallic material, polyphenylene sulfide (PPS), poly-ether-ether-keytone (PEEK), and combinations thereof.

4. The assembly according to claim 1, wherein the slot has a lower end spaced above the threads, and wherein the inner and outer annular members are in substantial contact with each other between the lower end of the slot and the threads.

5. The assembly according to claim 1, wherein the wall surfaces are cylindrical, and the assembly further comprises inner and outer protrusions respective formed along an outer circumference of the energizing ring and an inner circumference of the outer annular member of the seal ring, wherein respective upper and lower surfaces of the inner and outer protrusions have a slope less than a slope of respective lower and upper surfaces of the inner and outer protrusions, so that a force to urge the inner protrusion upward past the outer protrusion exceeds a force to urge the inner protrusion downward past the outer protrusion.

6. The assembly according to claim 1, wherein the threads comprise a set of external threads on an outer circumference of the inner annular member and a set of internal threads on an inner circumference of the outer annular member.

7. The assembly according to claim 1, wherein a set of wickers is formed on at least one of the seal surfaces.

8. The assembly according to claim 1, wherein the inner annular member of the seal ring includes an upward-facing shoulder projecting radially outward and wherein a lower terminal end of the outer annular member is landed on the shoulder.

9. A seal assembly, comprising:

a seal ring for sealing between inner and outer wellhead members, the seal ring having an axis and inner annular member and an outer annular member circumscribing a portion of the inner annular member;

a set of external threads on the inner annular member;

a set of internal threads on the outer annular member that engage the external threads to secure the inner and outer annular members together;

the inner annular member having a cylindrical outer wall surface spaced from a cylindrical inner wall surface of the outer annular member, defining an annular slot above the internal and external threads;

an annular energizing ring having a lower end insertable into the slot, the lower end having a greater radial thickness than the slot prior to entry into the slot, which causes the lower end to move the inner and outer annular members of the seal ring radially apart from each other and into sealing engagement with opposing seal surfaces on the inner and outer wellhead members;

wherein the lower end of the energizing ring forms metal-to-metal sealing engagements with the outer and inner wall surfaces; and wherein the threads define a pathway for fluid to flow from below the seal ring into the slot and into contact with the lower end of the energizing ring, wherein pressure of the fluid from below the seal ring produces a force to urge the inner annular member inward and the outer annular member outward.

10. The assembly according to claim 9, wherein:

an inlay band of a deformable material is formed on at least one of wall surfaces of the inner and outer annular members of the seal ring; and the energizing ring deforms the inlay band when fully located in the slot.

11. The assembly according to claim 10, wherein the inlay comprises a material that is selected from the list consisting of a metal, a non-metallic material, polyphenylene sulfide (PPS), poly-ether-ether-keytone (PEEK), and combinations thereof.

12. The assembly according to claim 9, wherein the slot has a lower end spaced above the external and internal threads, and wherein the inner and outer annular members are in substantial contact with each other between the lower end of the slot and the external and internal threads.

13. The assembly according to claim 9, further comprising inner and outer protrusions respective formed along an outer circumference of the energizing ring and an inner circumference of the outer annular member of the seal ring, wherein respective upper and lower surfaces of the inner and outer protrusions have a slope less than a slope of respective lower and upper surfaces of the inner and outer protrusions, so that a force to urge the inner protrusion upward past the outer protrusion exceeds a force to urge the inner protrusion downward past the outer protrusion.

14. The assembly according to claim 9, further comprising inner and outer protrusions respective formed along an outer circumference of the energizing ring and an inner circumference of the outer annular member of the seal ring, the protrusions being formed so as to radially interfere with and snap past each other as the energizing ring moves downward into the slot.

15. The assembly according to claim 9, wherein the external and internal threads are configured to remain in threaded engagement with each other after the lower end of the energizing ring fully enters the slot.

16. The seal assembly according to claim 9, further comprising:

inlay bands of a soft metal located on each of the wall surfaces of the inner and outer annular members; and wherein the energizing ring deforms the inlay bands when forming the metal-to-metal sealing engagements.

17. The seal assembly according to claim 9, wherein the inner annular member of the seal ring includes an upward-facing shoulder projecting radially outward and wherein a lower terminal end of the outer annular member is landed on the shoulder.

18. The seal assembly according to claim 9, wherein:

the portion of the outer wall surface of the inner annular that defines the slot has a smaller outer circumference than the external threads; and the portion of the inner wall surface of the outer annular member that defines the slot has a larger inner circumference than the internal threads.

19. A method for sealing an inner wellhead member to an outer wellhead member, comprising:

landing a seal assembly between the inner and outer wellhead members; the seal having an inner leg and a separate outer leg, a slot therebetween, the inner leg and the outer leg being secured to each other by threads located below the slot, the threads defining a pathway for fluid pressure below the seal assembly to be transmitted into the slot;

driving an energizing ring into the slot in the seal assembly to urge inner and outer legs of the seal assembly into engagement with the inner and outer wellhead members;

with the energizing ring, forming a seal in the slot against an inner surface of the outer leg and an outer surface of the inner leg to provide a seal against the fluid pressure below the seal ring, wherein an increase in the fluid pressure is transmitted to the slot and increases contact forces between the inner and outer legs of the seal assembly and the inner and outer wellhead members, respectively.

20. The method according to claim 19, further comprising the step of providing an inlay band of a deformable material on at least one of the inner and outer legs within the slot, and deforming the inlay band with the energizing ring while driving the energizing ring into the slot.

* * * * *